US005219450A

United States Patent [19]

Thurk

[11] Patent Number: 5,219,450

[45] Date of Patent: Jun. 15, 1993

[54] MOBILE ASPHALT MIX PLANT WITH COMPONENT SENSING AND DISTINCT STEERING MEANS

[76] Inventor: John H. Thurk, N. 1225 Roatz Rd., La Crosse, Wis. 54601

[21] Appl. No.: 926,346

[22] Filed: Aug. 6, 1992

Related U.S. Application Data

[63] Continuation of Ser. No. 646,364, Jan. 28, 1991, abandoned.

[51] Int. Cl.[5] ..... E01C 23/12; E01C 19/18; B28C 7/04

[52] U.S. Cl. ..... 404/91; 404/92; 404/108; 366/17

[58] Field of Search ..... 366/17-18, 366/16, 4, 6, 7, 22-23; 404/72, 77, 91-92, 95, 113, 108; 138/32; 432/225; 180/233-234; 280/263, 420-421

[56] References Cited

U.S. PATENT DOCUMENTS

| | | | |
|---|---|---|---|
| 1,960,866 | 5/1934 | Chadwick | 138/32 X |
| 2,081,472 | 5/1937 | Blood | 366/22 |
| 2,948,519 | 8/1960 | Bradshaw | 366/16 |
| 3,378,171 | 4/1968 | Eaton | 366/22 X |
| 3,625,488 | 12/1971 | Farnham | 366/22 X |
| 3,666,244 | 5/1972 | Nomura et al. | 366/7 |
| 3,857,552 | 12/1974 | Ohlson | 366/17 X |
| 4,155,654 | 5/1979 | Kennepohl et al. | 366/23 X |
| 4,272,212 | 6/1981 | Bauer, Jr. et al. | 404/91 X |
| 4,579,458 | 4/1986 | Ohlson | 366/23 |
| 4,802,139 | 1/1989 | Sasaki | 366/66 X |

FOREIGN PATENT DOCUMENTS

| | | | |
|---|---|---|---|
| 783396 | 11/1980 | U.S.S.R. | 366/4 |
| 863747 | 9/1981 | U.S.S.R. | 366/4 |
| 870563 | 10/1981 | U.S.S.R. | 366/4 |
| 876821 | 10/1981 | U.S.S.R. | 404/92 |

*Primary Examiner*—Terry Lee Melius
*Assistant Examiner*—Nancy P. Connolly
*Attorney, Agent, or Firm*—Shook, Hardy & Bacon

[57] ABSTRACT

A movable asphalt mixing plant which is towed behind a milling machine. The mixing plant includes an input conveyor which receives the crushed aggregate from the milling machine. The aggregate is then introduced into a pug mill carried by the mobile plant. A heated storage tank and appropriate pumps and conduits for asphaltic cement located on the mobile plant allow the asphaltic cement to be mixed with the aggregate in the pug mill. The amount of asphaltic cement added to the aggregate may be controlled by a microprocessor which receives input regarding the production rate and input weight of aggregate. Asphaltic paving material produced by the pug mill is dispensed from the rear of the plant. A heating system employing hot circulating oil is also provided to ensure that the pumps and conduits for the asphaltic cement flow freely. A steering mechanism is provided for the plant to ensure centering for proper reception of aggregate and dispensing of paving material. Both the front and rear axles of the plant are pivoted. A hydraulic cylinder is connected to the rear axle to provide steering for same. The axles for the front wheels are connected to a trailer tongue which is releasably connected to a hitch on the towing vehicle. The hitch is located on a free end of a drawbar, with the other end of the drawbar being pivotally connected to the towing vehicle. A hydraulic cylinder is connected between the towing vehicle and the drawbar to control the position of the hitch.

6 Claims, 3 Drawing Sheets

MOBILE ASPHALT MIX PLANT WITH COMPONENT SENSING AND DISTINCT STEERING MEANS

This is a continuation of copending application Ser. No. 07/646,364 filed on Jan. 28, 1991, now abandoned.

BACKGROUND OF THE INVENTION

1. Field of the Invention

The present invention relates in general to road construction equipment. In particular, the present invention relates to an improved device for on-site mixing of asphalt paving material.

2. Description of the Related Art

In recent years, the use of asphalt paving materials for roadways has become increasingly prevalent. Roadways formed with asphalt paving material provide a smooth driving surface and are relatively low maintenance, compared to other paving materials.

While relatively low maintenance, it is periodically necessary to resurface even asphalt roadways. One typical method for resurfacing asphalt roadways employs a known milling machine. This milling machine travels upon the asphalt roadway and literally tears up the roadway beneath it, breaking the roadway into pieces and gathering up these pieces. The pieces of asphalt roadway produced by the milling machine are fed out of a chute on the back end of the machine and are received in a series of dumptrucks.

The dumptrucks transport the asphalt roadway pieces to a recycling plant, where the pieces of roadway are crushed to the proper size and are combined with new asphaltic cement (asphalt) to produce asphalt paving material suitable to form a roadway. This asphalt paving material is then transported back to a roadway construction site where the roadway has been previously removed by the milling machine, where it is dispersed, rolled, etc. to produce an asphalt roadway.

SUMMARY OF THE INVENTION

An object of the present invention is to provide a device which will recycle asphalt roadway material into asphalt paving material on-site.

Another object of the present invention is to provide a device which may be connected to a milling machine and which will recycle the paving material produced by the milling machine on the fly.

Another object of the present invention is to provide a mobile asphalt recycling device which includes controls for producing the proper mix of aggregate and asphaltic cement to therefore provide a high quality asphalt paving material.

A further object of the present invention is to provide a mobile asphalt recycling device which is self contained except for the provision of the basic materials to form the asphalt paving material.

Yet another object of the present invention is to provide an improved apparatus for the steering of a towed vehicle.

These and other objects are achieved by a movable asphalt mixing plant which is towed behind a milling machine. The mixing plant includes an input conveyor which receives the crushed aggregate from the milling machine. The aggregate travels upon this conveyor and is then introduced into a pug mill carried by the mobile plant. A heated storage tank and appropriate pumps and conduits for asphaltic cement are also located on the mobile plant, and allow the asphaltic cement to be mixed with the aggregate in the pug mill.

The amount of asphaltic cement added to the aggregate in the pug mill may be controlled by a microprocessor which receives input regarding the production rate and input weight of aggregate. Asphaltic paving material produced from the mixing action in the pug mill is dispensed from the rear of the mobile recycling plant.

A heating system employing hot circulating oil is also provided to ensure that the pumps and conduits for the asphaltic cement flow freely. Additionally, a steering mechanism is provided for the mobile plant to ensure that the plant is centered for proper reception of the aggregate and dispensing of the paving material.

This steering mechanism includes pivoting both the front and rear axles of the mobile plant. A hydraulic cylinder is connected to the pivoted rear axle to provide steering for same. The axles for the front wheels are connected to a trailer tongue which extends forward of the mixing plant and is releasably connected to a hitch on the vehicle towing the mixing plant. The hitch is located on a free end of a drawbar, with the other end of the drawbar being connected to the towing vehicle for pivoting about a vertical axis. A hydraulic cylinder is connected between the towing vehicle and the drawbar to control the position of the hitch, and thus the front axle of the mobile mix plant.

DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
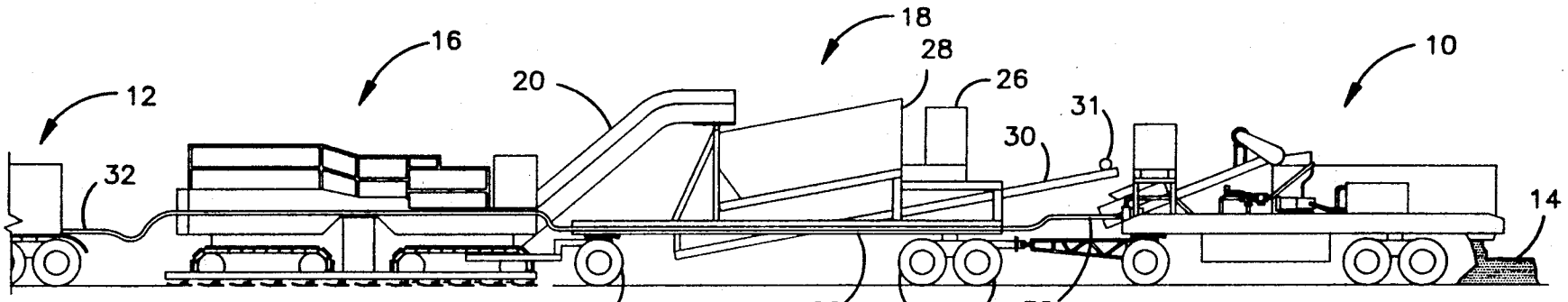
FIG. 1 is a side view of the device according to the present invention in combination with the normally associated roadway construction equipment.

With reference to FIG. 1, a mobile asphalt mixing plant, according to the present invention, is designated generally by reference numeral 10. Plant 10 is shown in operative relationship with the other construction equipment necessary for recycling of the asphalt roadway. This equipment includes a tanker 12 for supplying the asphaltic cement (asphalt) necessary for mixing with the crushed pieces of roadway (aggregate) to form the asphalt paving material 14. The first piece of equipment to actually act upon the roadway is a milling machine 16. The milling machine tows a crusher 18, which in turn tows the plant 10.

The general operation of each of the pieces of equipment shown in FIG. 1 is as follows. The milling machine 16, which is of standard design, breaks the existing asphalt roadway into pieces and removes these pieces. The pieces exit the milling machine 16 via an exit chute 20 and are received by the crusher 18.

The crusher 18 includes a frame 22 which is supported by a plurality of wheels 24. The frame 22 of crusher 18 supports a generator 26 for the supply of electrical power to the motor of the comminution device (not shown). Crusher 18 also includes a receiving bin 28 which receives the pieces of roadway from the exit chute 20 of milling machine 16. The comminution device (not shown) is located within the receiving bin 28, and further crushes the pieces of roadway to the desired size for use as aggregate for plant 10. Upon crushing, the aggregate is dropped onto a conveyor 30. The conveyor 30 is powered by a motor 31 which receives its electrical power from generator 26. The aggregate on conveyor 30 is thus transported rearwardly to be received by the plant 10.

The tanker 12, as noted above, supplies the asphalt to be mixed with the aggregate in the plant 10. The tanker 12 includes a main supply line 32 which is operatively connected to the storage tank of the tanker 12 and extends rearwardly past the milling machine 16 and crusher 18 to be operatively connected to the plant 10. While shown as a single piece, the main supply line 32 could, of course, be formed of several connecting segments.

The plant 10 combines the aggregate received from the conveyor 30 and the asphalt received through the main supply line 32 to form the asphalt paving material 14. The paving material 14 exits the rear of the plant 10 as a continuous berm of material extending along the length of the removed roadway. A known spreader device (not shown) will then take this berm of material and spread it laterally to form a substantially completed roadway. Various rollers (not shown) and other known equipment will then act to complete this substantially finished roadway.

It should be noted that the crusher 18 may be employed only as an overflow device if the pieces of roadway produced by the milling machine 16 are of the proper size for introduction to the plant 10 without further comminution. In such a situation, the receiving bin 28 of the crusher 18 will merely act to store the aggregate received from the exit chute 20 and provide a constant output along conveyor 30 to the plant 10.

Taken a step further, if the milling machine 16 further provides a sufficiently constant output of aggregate, the crusher 18 could be eliminated altogether, such that the aggregate would be received directly in the plant 10 from the exit chute 20 of the milling machine 16.

The details of the mobile asphalt mix plant according to the present invention will now be described with reference to FIGS. 2 and 3. The plant 10 includes a main frame 34 which is supported by a set of front wheels 36 and a set of rear wheels 38. While the details of the steering mechanism for the plant 10 will be discussed in more detail below, it is sufficient to note at this point that the set of front wheels 36 is pivotally attached to the mainframe 34 for rotation about a vertical axis. The front wheels 36 also include a tongue 40 by which the plant 10 is connected to and towed by the crusher 18 and/or milling machine 16.

A plant generator 42 is mounted upon the mainframe 34. Plant generator 42 provides all necessary electrical power for the electronics, circuitry, motors and pumps carried by the plant 10.

A plant conveyor 44 is mounted on the mainframe 34 at the front end thereof. The plant conveyor 44 includes an upstream end situated such that the aggregate falling from conveyor 30 of crusher 18 will be received thereon. An appropriate conveyor housing 46 may be provided at the upstream end to ensure that the aggregate falling to the plant conveyor 44 is reliably received on the plant conveyor. The conveyor housing 46 includes an appropriate upper opening to receive the aggregate. Plant conveyor 44 also includes an appropriate conveyor motor 48 which is operatively connected to the conveyor 44 to drive the endless belt of same.

The downstream end of plant conveyor 44 is located above the forward end of a pug mill 50. Pug mill 50 includes an appropriate mill housing 52 located below the downstream end of plant conveyor 44 to ensure that the aggregate falling from this end of conveyor 44 will be reliably received within pug mill 50. Mill housing 52 includes an appropriate upper opening to receive the aggregate.

Figure 5:
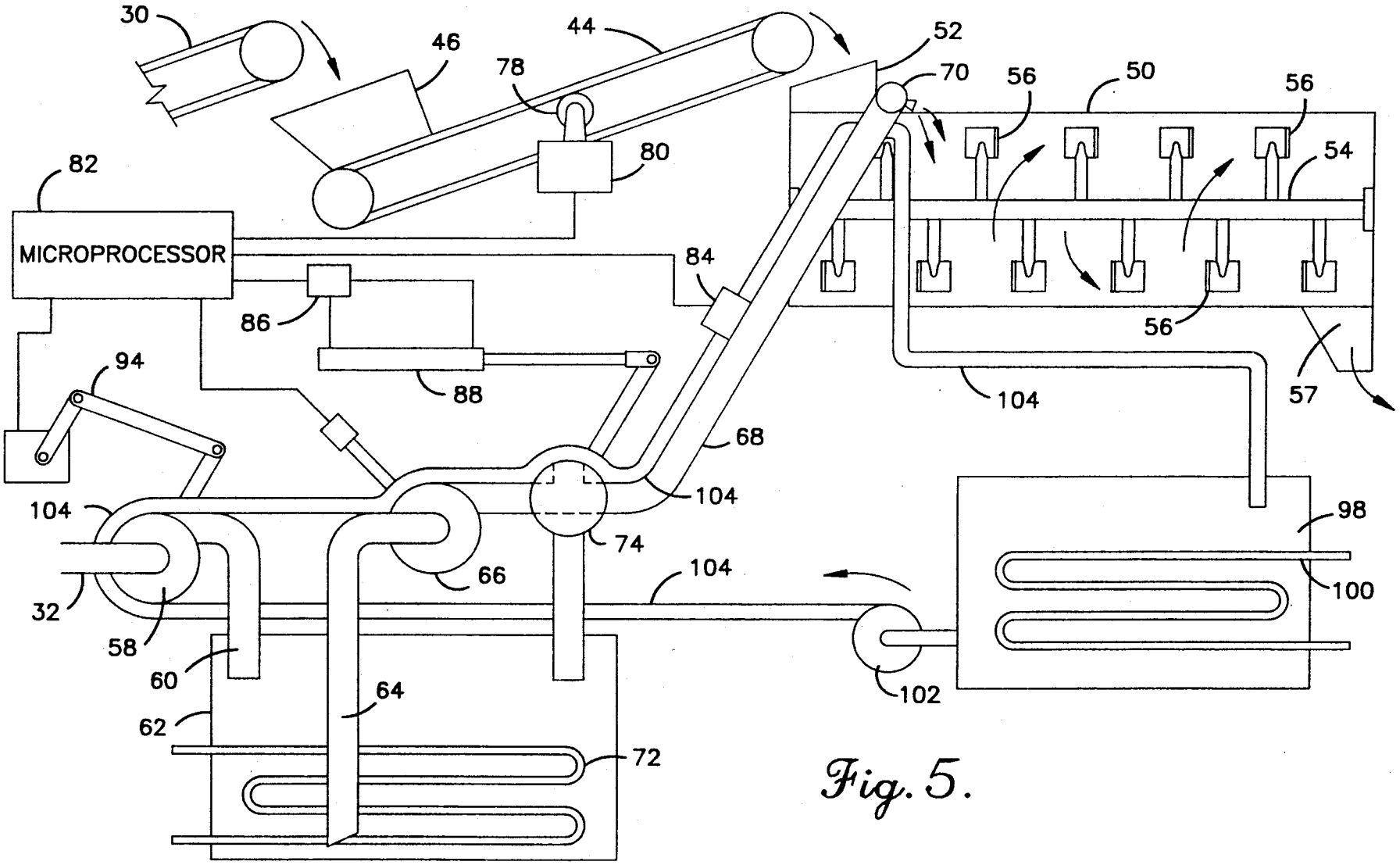
FIG. 5 is a schematic illustration of the supply of material to the pug mill and the associated heating mechanism.

As is best shown in FIG. 5, pug mill 50 has the general configuration of a trough. Within the confines of pug mill 50 is located a rotatably mounted mixing rod 54 which includes a plurality of mixing blades 56 extending radially outwardly therefrom. An appropriate motor (not shown) will cause rotation of the mixing rod 54, and thus the mixing blades 56, to thoroughly mix the aggregate received from plant conveyor 44 with the asphalt. This will form the asphalt paving material 14 which exits the pug mill 50 via outlet 57 to fall to the ground below the rear end of plant 10.

Outlet 57 has been shown merely as an opening in the rear of the pug mill 50. However, the outlet 57 could include a variable gate such that the amount of paving material 14 exiting the pug mill 50 may be controlled.

Plant 10 also includes means for supplying the asphalt to the pug mill for mixing with the aggregate. Specifically, plant 10 includes a supply pump 58 mounted thereon. The supply pump is operatively connected to the main asphalt supply line 32 at its inlet end, and is connected at its outlet end to a supply conduit 60. Supply conduit 60 in turn leads to a surge tank 62 mounted on the mainframe 34. As such, operation of supply pump 58 will cause the asphalt from tanker 12 to be pumped into the surge tank 62.

The asphalt is conveyed from the surge tank 62 to the pug mill 50 by a tank conduit 64 (FIG. 5) which has a first end thereof extending into the surge tank 62 and a second end thereof connected to the inlet of output pump 66 (FIG. 5). The output end of output pump 66 is connected to a first end of supply conduit 68. The other end of supply conduit 68 is located adjacent to the pug mill 50. This end of conduit 68 includes an appropriate nozzle means 70 which allows the asphalt to leave conduit 68 and mix with the aggregate in the pug mill 50.

To ensure that the asphalt remains at a temperature at which it has a sufficiently low viscosity, a heater 72 is supplied in or in operative contact with the surge tank 62.

A bypass valve may also be interposed in supply conduit 68, with a bypass conduit 76 leading from the bypass valve 74 back to the surge tank 62. This bypass valve will allow control of the entire supply cf asphalt to the pug mill 50. While bypass valve 74 provides gross control of the supply of asphalt, achieving the proper proportion of asphalt to aggregate requires fine control of the asphalt. An arrangement for providing such fine control is illustrated schematically in FIG. 5.

As shown in this figure, the plant conveyor 44 includes a weigh idler 78 in contact with the upper leg of the endless band comprising plant conveyor 44. Weigh idler 78 is operatively connected to a load cell 80. The combination of weight idler 78 and load cell 80 provides a constant or intermittent indication of the weight of aggregate being introduced into the pug mill 50. This aggregate weight information is introduced as input to a microprocessor 82 which is operatively connected to load cell 80.

The supply of asphalt to the pug mill is similarly monitored. In particular, a metering unit 84 is connected to conduit 68 to determine the fluid velocity or volumetric flow rate of the asphalt passing through conduit 68. Metering unit 84 is also operatively connected to microprocessor 82.

Microprocessor 82 will include appropriate programming to provide an output signal to control output pump 66, which is preferably a constant RPM variable displacement pump, operatively connected to microprocessor 82. The microprocessor will therefore monitor the amount of aggregate and asphalt introduced into the pug mill 50 and appropriately vary the amount of asphalt by control of output pump 66.

Microprocessor 82 may also be employed to control the bypass valve 74. By operatively connecting the microprocessor 82 to a solenoid 86 controlling a hydraulic piston and cylinder 88, a lever arm connected to bypass valve 74 may be moved to thus actuate the bypass valve. This feature may be employed such that the microprocessor 82 halts the flow of asphalt to the pug mill 50 upon a particular sensed condition or conditions. For example, an insufficient temperature for the asphalt in surge tank 62 or a lack of rotation of mixing rod 104 could be sensed by appropriate devices and cause microprocessor 82 to actuate bypass valve 74. An appropriate indicator light should also be activated in such a condition to notify the operator of the action taken by the microprocessor.

It may be readily seen that the gross and fine control of the asphalt flow from surge tank 62 will result in depletion of the asphalt in the surge tank at irregular intervals. As such, it is preferred that surge tank 62 include a float therein with a linkage arm 90 (FIG. 3) which may actuate a set of limit switches 92. These limit switches may be operatively connected to the microprocessor 82 such that receiving a signal from a respective one of the limit switches 92 will cause the microprocessor 82 to actuate the supply pump 58 via a solenoid linkage 94. In this manner, when the level of asphalt within surge tank 62 reaches a minimum level, linkage arm 90 will activate one of the limit switches 92, causing the microprocessor to activate supply pump 58. The supply pump 58 will remain active until linkage arm 90 actuates another of the limit switches 92, thus causing the microprocessor to deactivate supply pump 58.

It should be noted at this point that surge tank 62 may be eliminated in an alternative embodiment. In other words, the main asphalt supply line 32 could be directly connected to output pump 66. The use of surge tank 62 is preferred, however, as it allows the plant 10 to continue operating even when a tanker 12 has become emptied and is being replaced with a new, full, tanker 12.

An appropriate control panel 96 may be mounted on the mainframe 34 to house the microprocessor 82 and related electronics. It is preferred that control panel 96 include appropriate blending controls to adjust and vary the ratio of aggregate to asphalt maintained by microprocessor 82.

As was noted with regard to heater 72, the asphalt must be maintained at an elevated temperature to ensure that it has a sufficiently low viscosity to be pumped. The plant 10 according to the present device therefore includes an auxiliary heating means to maintain the asphalt at a sufficient temperature. As is best shown in FIG. 5, an oil tank 98 is provided. This oil tank is adapted to hold a supply of oil which acts as a heat transfer agent. Within the oil tank 98 is an auxiliary heater 100. This auxiliary heater serves to maintain the oil at an elevated temperature.

An oil pump 102 has the input side thereof connected to the oil tank 98 by a conduit. The output side of oil pump 102 is connected to exchange conduit 104. As is shown in FIG. 5, the exchange conduit 104 is formed to be in contact with the supply pump 58, output pump 66, supply conduit 68 and bypass valve 74. The end of the exchange conduit 104 opposite that which is connected to oil pump 102 returns to the oil tank 98 to complete the circuit.

In operation, the auxiliary heater 100 will be activated to keep the oil within oil tank 98 to a sufficiently high temperature. The oil pump 102 will then be activated to pump this hot oil through the conduit 104. The hot oil flowing through the conduit 104 will warm the conduit 104 by conduction, and in turn, the conduit 104 will warm the supply pump, output pump, supply conduit and bypass valve by conduction. Each of these later items will be sufficiently warmed to maintain the asphalt therein in a sufficiently fluid state.

The temperature of the oil in oil tank 98 may be controlled by an appropriate oil thermostat 106, preferably located near the control panel 96 for operator adjustment. An asphalt thermostat 108, for controlling the temperature of the asphalt within surge tank 62, may also be supplied adjacent the oil thermostat 106.

It should be noted that, while an oil heating system has been disclosed, other types of heating, for example, electrical, could be employed to maintain the asphalt within the pumps and conduits sufficiently fluid.

The plant 10 described above may be seen to provide an efficient means for converting pieces of asphalt paving into new asphalt paving material on-site. It is necessary, however, that the plant 10 be in the proper position to receive the aggregate and to deposit the asphalt paving material 14 produced by the plant 10 in the proper location. As such, a further aspect of the present invention is the provision of a steering mechanism for a towed vehicle.

Figure 2:
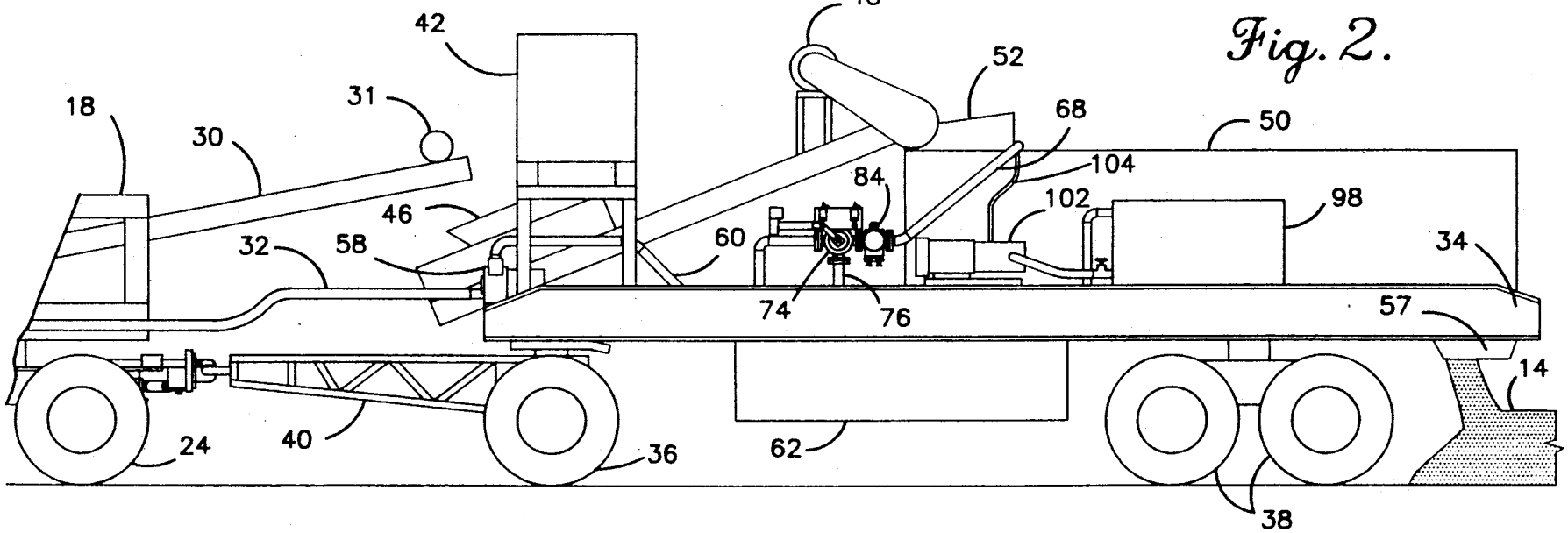
FIG. 2 is a left side view of the device according to the present invention.
Figure 3:
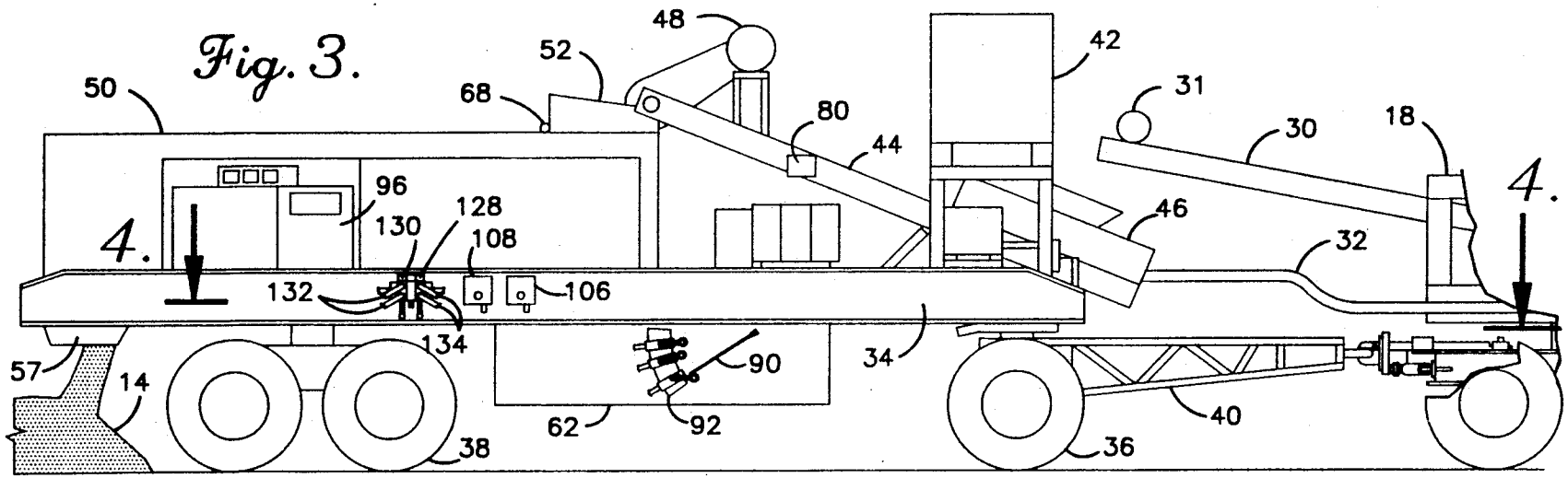
FIG. 3 is a right side view of the device according to the present invention.
Figure 4:
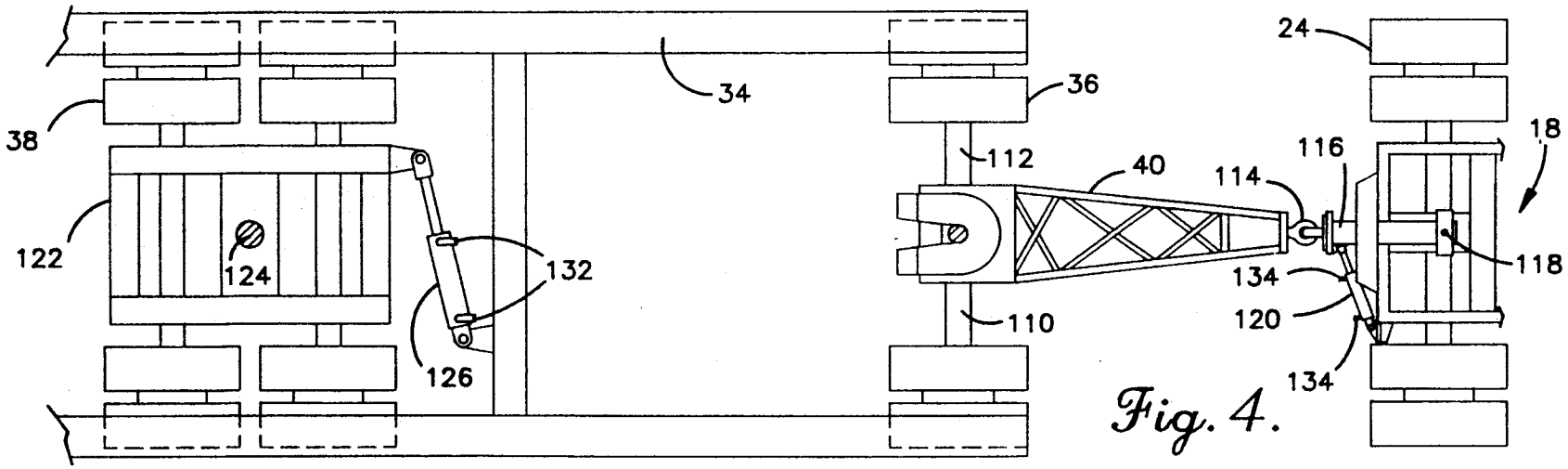
FIG. 4 is a bottom view showing the details of the steering mechanism.

As shown in FIGS. 2–4, the front wheels of the plant 10 include an axle assembly 110 which is pivotally connected to frame 34 by a front pivot bar 112 such that the axle assembly 110 and wheels 36 will rotate about a vertical axis. As noted above, a tongue 40 is connected to the axle assembly 110 in a manner similar to a standard trailer tongue such that the tongue 40 extends forwardly of the plant 10. The forward end of tongue 40 includes a coupler element 114 of any type commonly employed in the trailer art.

A drawbar 116 is coupled to the rear of the crusher 18 (or to the rear of milling machine 16 when crusher 18 is not employed), and the rear end of drawbar 116 includes a pintle hook adapted to engage with the coupler element 114 on the tongue 40. The drawbar 116 is coupled to the crusher 18 by a pintle pivot 118 which allows the drawbar 116 to rotate about a substantially vertical axis. Rotation of the drawbar 116 about the substantially vertical axis will result in the rear end of drawbar 116 moving through an arc with the pintle pivot 118 at the center thereof. As may be readily envisioned, such arcuate movement of the rear end of drawbar 116 will result in a rotation of the axle assembly 110 about the front pivot bar 112. This will in turn steer the forward end of plant 10 such that the conveyor housing 46 is in the proper position to receive the aggregate from conveyor 30.

To control the rotational movement of pintle bar 116, a pintle cylinder 120, in the form of a hydraulic cylinder, is provided. A first end of pintle cylinder 120 is pivotally connected to the chassis of the crusher 18. The other end of pintle cylinder 120 is connected to the pintle bar 116 at a point spaced from the pintle pivot 118. Expansion and contraction of pintle cylinder 120 will thus cause the pintle bar 116 to rotate about the substantially vertical axis of pintle pivot 118, thus steering the front end of plant 10. This will allow steering of the front end of the plant 10 such that the opening of conveyor housing 46 is in the proper location below conveyor 30 to receive the aggregate.

A similar arrangement may be provided for the rear wheels 38 of plant 10. Specifically, the rear wheels 38 may be mounted on a rear axle assembly 122 such as a tandem axle frame. The rear axle assembly 122 is rotatably mounted to the frame 34 by a rear axle pivot 124. The rear axle assembly 122 may therefore rotate about a substantially vertical axis.

To control rotation of the rear axle assembly about the substantially vertical axis a rear axle cylinder 126, in the form of a hydraulic cylinder, is provided. A first end of the rear axle cylinder 126 is pivotally mounted to the frame 34 of the plant 10. The other end of the rear axle cylinder 126 is pivotally connected to the rear axle assembly 122 at a point spaced from the rear axle pivot 124. As such, expansion and contraction of the rear axle cylinder 126 will cause rotation of the rear axle assembly 122 about the rear axle pivot 124. This will allow steering of the rear end of the plant 10, such that the asphalt paving material 14 may be deposited in the proper location.

It is preferred that the pintle cylinder 120 and rear axle cylinder 126 include hydraulic controls 128 and 130 located adjacent each other such that a single worker may control the steering of both the front and rear of the plant 10. The hydraulic controls 128 and 130 may conveniently be placed adjacent the control panel 96 and thermostats 106, 108.

The hydraulic controls 128 and 130 will, of course, be interposed between a source of hydraulic pressure (not shown) and the associated cylinder. As such, hydraulic lines 132 will extend between the hydraulic control 130 and rear axle cylinder 126. Similarly, hydraulic lines 134 will extend between hydraulic control 128 and pintle cylinder 120. For convenience, it is preferred that the source of hydraulic pressure be located on the plant 10. It is also preferred that the pintle cylinder 120 and/or the pintle bar 116 include locking means such that the pintle bar 116 may be fixed against rotation at a centered position for normal towing.

It is also noted that the control panel 96, hydraulic controls 128 and 130 and thermostats 106 and 108 are all located on the right hand side, viewed in the direction of travel, of the plant This will allow workers to monitor and adjust the various controls while the entire bulk of the plant 10 is interposed between the workers and the lane of oncoming traffic, assuming that the plant 10 is being used in the normal direction of traffic.

It is also possible to provide a platform laterally outside of the rear wheels 38 such that a worker may stand on the platform to view and operate the various controls without the need for walking to keep up with the plant 10. Such a platform is preferably removable such that the plant 10 may be towed to and from the work site without exceeding vehicle width limits.

While the invention has been described in detail above, it should be readily apparent to those skilled in the art that various alterations and modifications may be made without departing from the scope of the invention. For example, a pug mill of a different design may be employed. Hydraulic motors, rather than electric motors, may be employed to drive the conveyor and pug mill. Additionally, hydraulic cylinders need not be used in all cases, but could be alternatively replaced with appropriate solenoids or rack and pinion arrangements.

From the foregoing it will be seen that this invention is one well adapted to attain all ends and objects hereinabove set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A mobile asphalt mix plant adapted to be towed along a roadway to receive reclaimed asphaltic paving material and mixing said reclaimed material with additional asphalt to produce new paving material to be installed on the roadway, all while the plant is moved along the roadway, said plant comprising:

an elongated frame;

means carried by the frame proximal the leading end of the latter for continuously receiving said reclaimed material;

means carried by the frame for adding asphalt to said reclaimed material;

means operably associated with the receiving means and said asphalt adding means to sense the quantity of reclaimed material received and to vary the amount of asphalt added in response to said quantity sensed by the sensing means;

mixer means carried by the frame for mixing said reclaimed material and the asphalt to produce said new paving material, the mixer means including an outlet means for the discharge of the new paving material placed on the roadway in disposition to be spread on the latter;

steerable front wheel means coupled with the frame proximal the leading end of the frame for supporting the frame;

steerable rear wheel means coupled with the frame-proximal the trailing end of the frame for supporting the frame; and means operably coupled with said front wheel means for steering the latter to move the frame and the receiving means laterally into proper disposition for receiving said reclaimed material as the frame is moved longitudinally along the roadway; and means operably coupled with said rear wheel means for steering said rear wheel means laterally to dispose the discharge in proper position for placement of said new material on the roadway as the frame is moved longitudinally along the roadway.

2. A mobile asphalt mix plant as set forth in claim 1 wherein said steerable front wheel means includes a wheel and axle assembly, means mounting said assembly to the frame for pivoting movement with respect to the frame about on upright axis, said steering means being operably coupled with the assembly for pivoting the latter about said axis to effect lateral movement of the front end of the frame as the latter is towed longitudinally of the frame along the roadway.

3. A mobile asphalt mix plant as set forth in claim 2, said plant being adapted to be towed along a roadway longitudinally of the frame, the plant including:

an elongated rigid tongue projecting forwardly of the assembly for pivoting the latter about said upright axis;

an elongated, rigid drawbar having a forward end and a trailing end, the trailing end being pivotally coupled with the outer end of the tongue, the forward end of the drawbar being adapted to be coupled to said towing vehicle for swinging about a vertical axis; and means operably coupled with the drawbar for swinging the latter about said vertical axis to move the tongue and the assembly to steer the plant.

4. A mobile asphalt mix plant as set forth in claim 3, said steerable rear wheel means including a rear wheel and axle assembly;

means for pivotally coupling said rear wheel and axle assembly with the frame for movement about an upright axis proximal the rear end of the frame; and means operably coupled with said rear wheel and axle assembly for swinging the latter about said upright axis to steer the rear end of the plant as the latter is towed longitudinally of the roadway.

5. A mobile asphalt mix plant as set forth in claim 3 wherein drawbar swinging means includes a hydraulic cylinder and piston assembly, operably coupled with the drawbar, and means for selectively operating of said hydraulic assembly.

6. A mobile asphalt mix plant as set forth in claim 4 wherein said rear wheel and axle swinging means includes a hydraulic cylinder and piston assembly operably coupled with the rear wheel and axle assembly, and means for selectively operating said hydraulic assembly.

* * * * *